US005451042A

United States Patent [19]

Cuir et al.

[11] Patent Number: 5,451,042

[45] Date of Patent: Sep. 19, 1995

[54] DEVICE FOR DISTRIBUTING SEMI-RIGID SHEETS, PARTICULARLY OF CARDBOARD, FROM A STACK

[76] Inventors: Jean-Pierre Cuir, 36 avenue de Brigode; Gérard Cuir, 23 allée des Grands Champs, both of 59650 Villeneuve d'Ascq, France

[21] Appl. No.: 195,263

[22] Filed: Feb. 14, 1994

[30] Foreign Application Priority Data

Feb. 23, 1993 [FR] France ..... 93 02299

[51] Int. Cl.[6] ..... B65H 3/64

[52] U.S. Cl. ..... 271/112; 271/114

[58] Field of Search ..... 271/112, 114

[56] References Cited

U.S. PATENT DOCUMENTS

| | | | |
|---|---|---|---|
| 4,653,742 | 3/1987 | Sasaki et al. | 271/114 |
| 4,705,262 | 11/1987 | Hirota et al. | 271/122 |
| 4,896,872 | 1/1990 | Sardella | 271/112 X |
| 4,982,950 | 5/1990 | Sardella | 271/112 |
| 5,006,042 | 4/1991 | Park | 271/114 X |
| 5,048,812 | 9/1991 | Holmes | 271/112 X |
| 5,050,852 | 9/1991 | Sawada et al. | 271/112 X |
| 5,064,183 | 11/1991 | Nishigaki et al. | 271/10 |

FOREIGN PATENT DOCUMENTS

| | | | |
|---|---|---|---|
| 0183361 | 6/1986 | European Pat. Off. | B65H 3/06 |
| 0379306 | 7/1990 | European Pat. Off. | B65H 3/02 |
| 0414157 | 2/1991 | European Pat. Off. | B65H 3/06 |

*Primary Examiner*—H. Grant Skaggs
*Assistant Examiner*—Carol L. Druzbick
*Attorney, Agent, or Firm*—Ladas & Parry

[57] ABSTRACT

This invention relates to a device for distributing semi-rigid sheets, one by one, below or above a stop behind which said sheets are stacked. The device has no sheet-extraction system in front of the stop and no fixed surface in contact with the stack in the proximity of the stop. It comprises at least three cylinders adapted to entrain by friction the sheet with which they are in contact, the axis of the outlet cylinder being vertical with respect to the stop. Moreover, it comprises a device for synchronizing the cylinders so that, during distribution of a given sheet, on the one hand, each of the cylinders upstream of the outlet cylinder is decelerated after the sheet has left contact therewith and, on the other hand, the outlet cylinder is decelerated after the rear edge of the sheet has substantially gone beyond the vertical with respect to the stop, the cylinders upstream already being in stopped position.

9 Claims, 3 Drawing Sheets

DEVICE FOR DISTRIBUTING SEMI-RIGID SHEETS, PARTICULARLY OF CARDBOARD, FROM A STACK

FIELD OF THE INVENTION

The present invention relates to the distribution, one-by-one, of semi-rigid sheets, in particular of cardboard and particularly of corrugated cardboard, from a stack of sheets substantially of the same format. It relates more particularly to a device allowing such a distribution and which comprises rotary supply members adapted to entrain, by friction, the sheet with which they are in contact below or above a stop, which blocks in position all the other sheets of the stack.

BACKGROUND OF THE INVENTION

Such distributors are well known in the cardboard and more precisely corrugated cardboard industry, sometimes under the term feeders. They are intended precisely to supply a sheet to introduce it in synchronism in a receiving machine such as a printer, cutter, . . .

The front edge of the stack abuts on one (or more) vertical stops, which is adjustable in height. If it is question of removal of the sheets from the bottom of the stack, the free space between the lower edge of the stop and the part of the feeder, opposite this lower edge, on which the stack abuts, must be slightly greater than the thickness of one sheet and smaller than the thickness of two sheets. If it is question of removal of the sheets from the top of a stack mounted on an elevator system, the free space in question will be delimited by the upper edge of the stop. In this way, during entrainment of the sheet by the rotary members, only the sheet in contact with said members is entrained by friction, whilst the other sheets of the stack are maintained in position against the stop.

Document EP 0183 361 proposes a device of this type in which the sheet is entrained with the aid of rotating rollers, whilst the sheet is applied by vacuum on said rollers. These rollers are disposed in the form of a plurality of parallel sets, disposed towards the front part of the stack, located near the stop, and are animated by an oscillating movement.

The feeder according to document EP 0183 361 comprises extractor rolls, located behind the stop, and adapted to ensure total extraction of the sheet and introduction thereof in the following machine. It also comprises vertical pushers which are disposed between the sets of rollers and which raise the stack as soon as the sheet is entrained by the extractor rolls. These vertical pushers avoid the rollers entraining the sheet which follows, in the stack, the sheet to be distributed. The presence of the extractor rolls is rendered necessary due to the forces of friction coming into play between the sheet to be distributed and the fixed parts, on which said sheet abuts during its displacement, whether it be the feed surface, located immediately beneath the lower edge of the stop, the pushers, or the surfaces on which the rear parts of the stack rest.

With respect to a sheet of corrugated cardboard, the extraction of the sheet in the course of distribution by these extractor rolls presents two types of drawbacks. On the one hand, the nipping of the sheet between the two rolls may lead to a deterioration of the corrugated cardboard, and, on the other hand, it is necessary to effect a precise adjustment of the distance between the two rolls as a function of the thickness of the cardboard.

These difficulties were solved, particularly in document EP 379 306, by replacing these two extractor rolls by the combination of two elements, namely drive belts and a suction system, ensuring application of the sheet during distribution on said belts.

In EP 379 306, the machine was also simplified by eliminating the vertical pushers. To that end, as the device comprises at least two sets of rotary transfer members, each set is driven by an independent, variable-speed motor, and the device comprises a control system which is adjusted so as to start and accelerate the motors and therefore the rotary transport members at a predetermined speed in order to advance the sheet to be distributed, and to decelerate or stop each motor and the corresponding transport member after the sheet has moved and before the following sheet has come into contact with a rotary transport member.

Thanks to these particular kinematics of the different sets of rotary members, there is no longer need to lift the stack between said rotary members, since, after the passage of the rear edge of the sheet to be distributed at the level of the stop, the transport members which come into contact with the penultimate sheet are stopped.

This latter device marks considerable progress over the earlier device. However, the purpose of Applicants is to propose a device for distributing, one-by-one, semi-rigid sheets, particularly of cardboard, from a stack, which presents additional advantages, namely the pure and simple elimination of the means for extracting the sheet, located in front of the stop, and a better precision in the location of the sheet to be distributed on the following station.

SUMMARY OF THE INVENTION

This object is perfectly attained by the device according to the invention for distributing, one-by-one, semi-rigid sheets, particularly of cardboard and more particularly of corrugated cardboard, below or above a stop, behind which said sheets are stacked. In known manner, this device comprises rotary supply members, mounted in a suction chamber and adapted to entrain by friction, below or above the stop, the sheet with which they are in contact, rotation of said supply members being controlled by drive means.

In characteristic manner, as the device is bereft of a sheet-extraction system in front of the stop and of fixed surface in contact with the stack in the proximity of said stop, the rotary supply members consist of at least three cylinders, the axis of the outlet cylinder being vertical with respect to the stop; moreover, the device comprises means for synchronizing the cylinders so that, during distribution of a given sheet, on the one hand, each of the cylinders upstream of the outlet cylinder is decelerated after said sheet has left contact therewith and, on the other hand, the outlet cylinder is decelerated after the rear edge of said sheet has gone beyond the vertical with respect to the stop, the upstream cylinders already being in stopped position, and therefore after the following sheet has come into contact therewith.

Depending on the particular kinematics of the cylinders of the device of the invention, and contrarily to what is provided in document EP 0379 306, when the rear edge of the sheet in the course of distribution leaves a given cylinder, in accordance with the explanations which will be given hereinafter in the description of the embodiment, the following sheet in the stack comes into contact with said cylinder whilst the latter is still in rotation, in its phase of constant speed, the phase of deceleration of the cylinder beginning only slightly after this step.

Consequently, there is produced a forward entrainment of the following sheet which, during distribution of a given sheet, blocks said following sheet in position. In fact, the slight entrainment provoked by the contact of the following sheet with the cylinders upstream of the outlet cylinder, in its phase at constant speed then in the course of deceleration, effects perfect alignment of the front edge of said following sheet along the stop.

It might have been thought that this slight entrainment would have negative repercussions. In fact, when the sheet to be distributed passes beneath the stop, the following sheet is no longer maintained in height and descends to the level of the space between the stop and the outlet cylinder.

At that precise instant, the outlet cylinder is still in rotation, at constant speed and will begin the deceleration phase. It might therefore have been thought that the contact between this following sheet and the outlet cylinder in rotation would provoke a forward displacement of the following sheet. This is not so, thanks to the combination of two elements employed in the device of the invention, namely, on the one hand, the fact that the cylinders upstream of the outlet cylinder are stopped at that precise moment and, on the other hand, the suction, as will be explained more clearly in the description of the embodiment which will be given hereinafter.

The device of the invention preferably comprises rotary bearing members, free to rotate, disposed so that they support the rear part of the stack whilst the supply cylinders support the front part thereof. It will be question in particular of rollers mounted on at least one shaft, parallel to the axis of rotation of the supply cylinders.

The sheet in the course of distribution is therefore not in abutment on any fixed part of the machine.

This particular arrangement aims at reducing as much as possible the forces of friction capable of braking the displacement of a sheet during distribution thereof.

The front stop is advantageously a continuous plate.

In that case, the device of the invention advantageously comprises two shafts, supporting rollers, whose ends are mounted on longitudinal arms, as well as a rear blocking stop, which moves on the end of said arms; moreover, a system of entrainment makes it possible to displace the rear stop and correlatively the two roller-support shafts as a function of the length of the stacked sheets.

The device preferably also comprises means for adaptation to the width of the stack, said means comprising:

a) two lateral plates for blocking the stack, provided with transverse displacement means, and b) two covering members, extending on either side of the blocking plates up to the outer edges of the suction chamber.

BRIEF DESCRIPTION OF THE DRAWINGS

The invention will be more readily understood on reading the following description of the preferred embodiment of the device for distributing, one-by-one, sheets of corrugated cardboard from a stack, having no system for extracting the sheet during distribution, with reference to the accompanying drawings, in which.

DESCRIPTION OF PREFERRED EMBODIMENT

Figure 1:
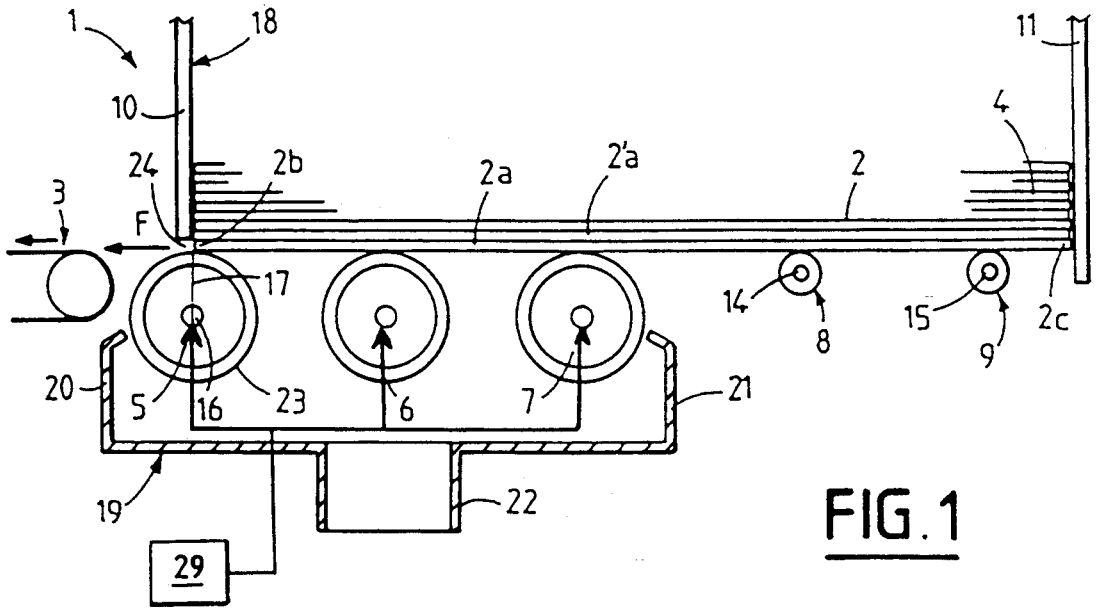
FIG. 1 is a side view in section of the distributor of the invention.
Figure 2:
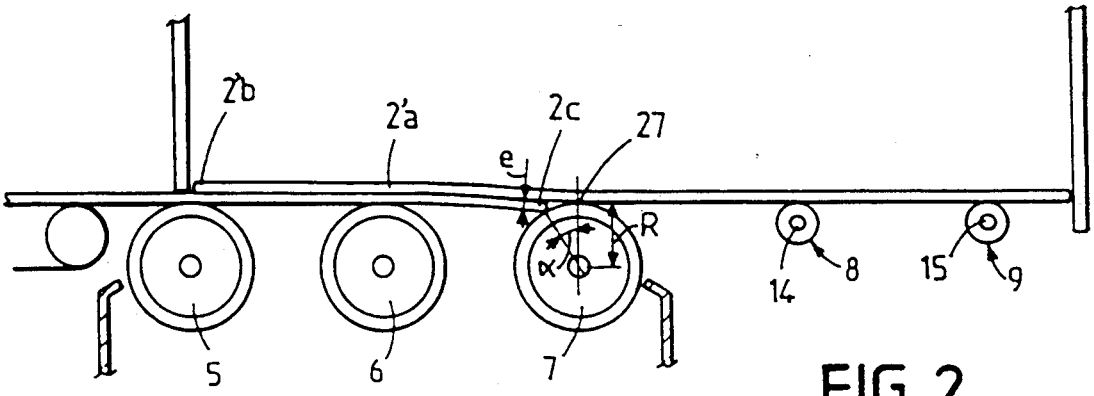
FIGS. 2 and 3 illustrate the steps of operation of the distributor of FIG. 1.
Figure 3:
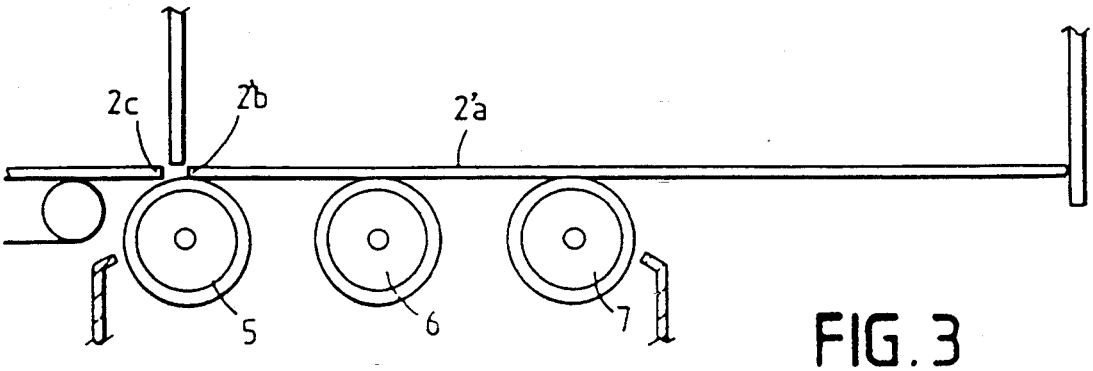

Referring now to the drawings, the distributor 1 of the invention is intended to supply sheets 2 of corrugated cardboard towards, for example, a cut-out or printing station. FIG. 1 shows an element of this station 3, ensuring displacement of the distributed sheet inside said station.

In the distributor 1, the sheets 2 of corrugated cardboard are disposed in the form of a substantially regular stack 4, which rests in its front part on three supply cylinders 5, 6 and 7 and, in its rear part, on two sets of rollers 8 and 9, respectively.

The stack 4 is approximately blocked in position thanks to a front stop 10 which is a continuous plate, a rear stop 11 and two lateral plates 12 and 13 also forming stops. In this way, the front and rear stops 10 and 11 and the lateral plates 12 and 13 define a receptacle for the stack 4.

The three supply cylinders 5, 6 and 7 are driven in rotation in synchronized manner, as will be explained hereinafter, whilst the rollers 8 and 9 are mounted to rotate freely on shafts 14, 15.

The first cylinder 5, which is located foremost of the stack 4, in the direction of evacuation illustrated by arrow F, has its shaft for rotation 16 positioned plumb with the front stop 10. More precisely, the plane 17 formed by the face 18 of the stop 10 which faces towards the inside of the receptacle, passes through the axis of rotation 16 of this first cylinder 5, which will be referred to hereinafter as outlet cylinder.

A suction chamber 19 is provided beneath the three supply cylinders 5, 6 and 7. The front (20) and rear (21) transverse uprights of this chamber 19 come, in their upper part, in the immediate proximity of the outer surface of the outlet cylinder 5 for the front upright 20 and of the third cylinder 7 for the rear upright 21. The suction chamber 19 comprises a conduit 22 for connection towards known depression-creating means.

The outer surface of each cylinder 5, 6, 7 must have a high coefficient of friction in order to effect entrainment by friction of a sheet of corrugated cardboard. This surface with high coefficient of friction may possibly be obtained with the aid of a sleeve 23 which is directly fitted on the body of the cylinder 5, 6, 7. In this way, it is possible to replace the sleeve 23 in the event of wear thereof.

Driving of the three supply cylinders 5, 6, 7 in rotation is synchronized in order to respect the following two conditions. According to the first condition, during distribution of a given sheet 2*a*, which is the last sheet of the stack 4, each of the three cylinders 7, 6, 5 is braked, one after the other, only after said sheet 2*a* leaves the corresponding cylinder. According to the second condition, the two cylinders 6, 7, located upstream of the outlet cylinder 5, must be stopped when the sheet 2*a* leaves the outlet cylinder 5.

The expression "leaves the cylinder" covers different situations depending on whether it is question of cylinders 7, 6 upstream of the outlet cylinder or of the outlet cylinder itself. With respect to the cylinders 7, 6 upstream of the outlet cylinder 5 (FIG. 4), it is considered that the sheet 2*a* leaves the corresponding cylinder 7 or 6, when the rear edge 2*c* of said sheet 2*a* no longer has any effective contact with the surface of said cylinder, for example 7 and the following sheet 2'*a* comes into contact with the surface of said cylinder 7, tangentially thereto along the generatrix 27. When the following sheet 2'*a* rests on the cylinder 7, along generatrix 27, the cylinder 7 has already rotated by an angle $\alpha$ which is such that cos $\alpha$ is equal to (1 - e/R) in which e is the thickness of the sheet 2*a* at the level of its rear edge 2*c* and R is the radius of the cylinder 7. In fact, the sheet 2'*a* comes into contact with the generatrix 27 only when the rear edge 2*c* of the sheet 2*a* has moved by a distance sufficient for said edge 2*c* to be offset in height by its thickness e under the effect of the suction. On the other hand, being question of the outlet cylinder 5, it is considered that the distributed sheet 2*a* leaves the outlet cylinder 5 as soon as it passes beneath the stop 10, beyond the plane 17.

Consequently, the distributor 1 according to the invention operates as follows: The sheets of corrugated cardboard have been placed as a stack 4 inside the receptacle formed by the front and rear stops 10 and 11 and the lateral plates 12 and 13. The first sheet 2*a* to be distributed is therefore in abutment, from the rear to the front, solely on the two sets of rollers 9, 8 then on the three supply cylinders 7, 6, 5 respectively, without any contact with the fixed-surfaces of the machine.

Because the stop 10 is plumb with the axis 16 of rotation of the outlet cylinder 5, the sheet 2*a* abuts on said outlet cylinder 5 with a lesser force than it does on the other two cylinders 6 and 7.

In order to ensure distribution of the sheet 2*a*, the depression-creating means run continuously, which has for its effect to apply the sheet 2*a* on the surface of the three cylinders 5, 6, 7. This is all the more important as the majority of the sheets of corrugated cardboard may present bending-type deformations and it is therefore necessary to flatten said cardboard so that the front edge 2*b* of the sheet 2*a* is rectilinear at the level of the free space 24 located between the front stop 10 and the outlet cylinder 5.

Distribution of the sheet 2*a* is effected by simultaneously rotating the three supply cylinders 5, 6, 7 in synchronism with the operational cycle of the downstream station 3, until a desired speed for the introduction of the sheet 2*a* in this station is attained. The supply cylinders 5, 6, 7 are then animated at a constant speed.

The forces of friction coming into play, due to the suction and the weight exerted by the stack on the cylinders 5, 6 and 7, provoke displacement of sheet 2*a* in the direction of arrow F beneath stop 10. During this displacement, the upper face of the sheet 2*a* comes into friction with the lower face of the following sheet 2'*a*; however, the forces coming into play between the two sheets 2*a* and 2'*a* are slight having regard to the forces of friction at the level of the supply cylinders 5, 6, 7.

When the rear edge 2*c* of the sheet 2*a* leaves the surface of the most upstream cylinder 7, the following sheet 2'*a* is already in contact with the surface of said cylinder 7.

In fact, it must be known that the suction necessary for applying the sheets on the drive cylinders in order to obtain sufficient forces of friction to avoid slide of said sheets on said cylinders, corresponds to depressions of the order of 5,000 Pa. As an example of a sheet of corrugated cardboard of 500 g/m$^2$, having a thickness of 4 mm, the effect of the depression produces a vertical acceleration of the order of 10,000 m/sec$^2$ in application of the law $F=m\gamma$, in which F is the force in Newton applied to a body of mass m and $\gamma$ the acceleration. With such an acceleration, the time that the sheet will take to cover a distance corresponding to its thickness, viz. 4 mm, will be of the order of a thousandth of a second, in application of the law of uniformly accelerated movement, namely $x=\frac{1}{2}\gamma t^2$ in which x is the displacement and t the corresponding time.

Figure 4:
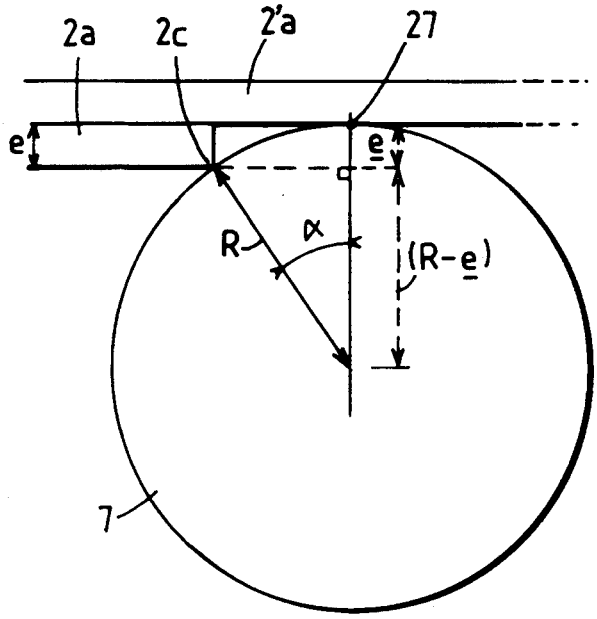
FIG. 4 is a partial view in detail of FIG. 2.

In a precise embodiment, with a cylinder 7 having a diameter of 80 mm, the distance between the rear edge 2*c* of the sheet 2*a* and the tangent point 27 of the following sheet 2'*a*, in accordance with what is shown in FIG. 4, is of the order of 17.4 mm. If a rate of 10,000 sheets per hour and a format for each sheet of 1 meter are considered, the speed of displacement of a sheet will be at minimum of the order of 3 meters/second. Under these conditions, the time that the rear edge 2*c* will take to cover the above-mentioned distance of 17.4 mm will be 5.8 thousandths of second, i.e. a time much greater than that necessary for sheet 2'*a* to be applied on cylinder 7. This explains that, when the sheet 2*a* is in the position shown in FIG. 4, the following sheet 2'*a* is already in contact with the cylinder 7. It is from this position that slowing-down of the cylinder 7 may be started without braking the sheet 2*a*. In practice, according to the invention, to overcome possible differences in length, in positioning and possible slides of the sheet 2*a* during its transport, deceleration of the cylinder 7 is started when the rear edge 2*c* of the sheet 2*a* has passed beyond the position shown in FIG. 4 by about 10 mm. Consequently, the following sheet 2'*a* comes into contact with cylinder 7 whilst the latter is still in its phase of constant speed.

It will be understood that these kinematics are fundamentally different from those provided in the device of document EP 0379 306. In fact, this document provides that each drive cylinder is decelerated before the following sheet is in contact with said cylinder. In other words, according to the kinematics of document EP 0379 306, the cylinders are decelerated before the sheet is in the position of FIG. 4, whilst, in the feeder of the present invention, the cylinder 7 begins its deceleration only when the rear edge 2*c* of the sheet 2*a* has passed beyond the position shown in FIG. 4, for example of the order of 10 mm.

The fact that the deceleration according to document EP 0379 306 begins whilst the sheet is in contact with a cylinder, provokes braking forces on said sheet. This is what necessitates in this feeder extraction means downstream of the stop. On the contrary, in the feeder of the present invention, the particular kinematics mentioned above, combined with the arrangement of the cylinders, particularly that of the outlet cylinder 5, and with the absence of friction of the sheet 2*a* on any fixed part, make it possible completely to evacuate the sheet 2*a* from the stack without there being any need to employ a system of extraction downstream of the stop 13, as is the case in the feeder of document EP 0379 306.

After the rear edge 2*c* of the sheet 2*a* has left the surface of the most upstream cylinder 7, said cylinder 7 is braked, so that it is completely stopped when the rear edge 2*c* will leave the outlet cylinder 5 and preferably as rapidly as possible in order to limit wear of the lining of this cylinder.

When the same rear edge 2c will leave the intermediate cylinder 6 and therefore the following sheet 2'a will be in contact with the surface of said intermediate cylinder 6, the latter will be braked under the same conditions as those of the cylinder 7, so that it is completely stopped when said edge 2c will leave the outlet cylinder 5.

In a case that the following sheet 2'a comes progressively into contact with the two cylinders, firstly 7 then 6, located upstream of the outlet cylinder, whilst the sheet 2a to be supplied is still in the free space 24, the rotation of these two upstream cylinders 6, 7 provokes a slight displacement of said following sheet 2'a. This slight displacement blocks the following sheet 2'a along the inner face 18 of the stop 10. Such blockage makes it possible to correct possible deviations that may be produced during the approximate constitution of the stack 4. As the front edge 2'b of the following sheet 2'a is in abutment over the whole of its length against the stop 10, there is no risk of deterioration of said front edge 2'b.

When the rear edge 2c of the sheet 2a to be distributed leaves the outlet cylinder 5, the front edge 2'b of the following sheet 2'a is then applied under the effect of suction, against the surface of the outlet cylinder 5 very rapidly, as has been seen hereinabove, in a time of the order of one thousandth of second. At that precise moment, the outlet cylinder 5 is still at constant speed and begins its phase of deceleration after the edge 2c has passed beyond plane 17 by about 1 cm. However, as is imposed by the second condition of the synchronism of the three cylinders, the two most upstream cylinders 6, 7 are maintained in stop position. The displacement of the following sheet 2'a, under the effect of the rotation of the outlet cylinder 5, is impeded by the forces of friction at the level of the zones of contact between the lower face of the sheet 2'a and the two most upstream cylinders 6 and 7. Due to the arrangement of the cylinders, the bearing forces of the stack and the forces due to the depression of chamber 19 are greater on cylinders 6 and 7 than on cylinder 5, so that the sheet is maintained in position. It is this condition which imposes, for this type of feeder, the existence of at least three drive cylinders.

Consequently, the position of the front edge 2'b of the sheet 2'a is not affected by the fact that the outlet cylinder 5 is still in rotation when said edge 2'b is applied against the surface of said outlet cylinder 5.

As will have been noted, the distribution of the sheet 2a has been effected without it being necessary to employ an outside extraction system, compensating the forces of friction of said sheet 2a on fixed parts, or of the cylinders in the course of deceleration as is the case for the machines already known. The system of conveying to the following station 3 may thus be a system without suction nor without nip roll, but simply a system enabling the sheet 2a to be conveyed in synchronization with the outlet cylinder 5.

According to a preferred embodiment, the distributor 1 is provided to be adapted to the different formats of sheets 2, both in length and in width.

With respect to the adjustment in length, the two shafts 14 and 15 as well as the rear stop 11 move on two longitudinal arms which are mounted on the frame of the distributor. A drive system displaces the rear stop 11 and correlatively drives the shafts 14 and 15. This system is adjusted so that the stroke of displacement of the shaft 14 is approximately ⅔ that of the shaft 15 and of the stop 11.

Figure 5:
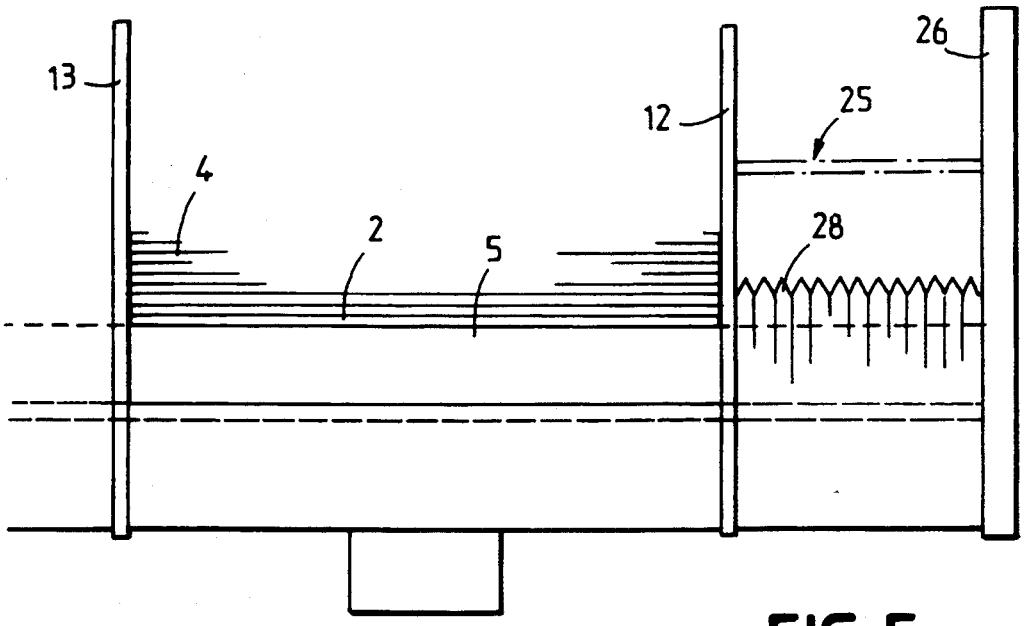
FIG. 5 is a front view of this same distributor.
Figure 6:
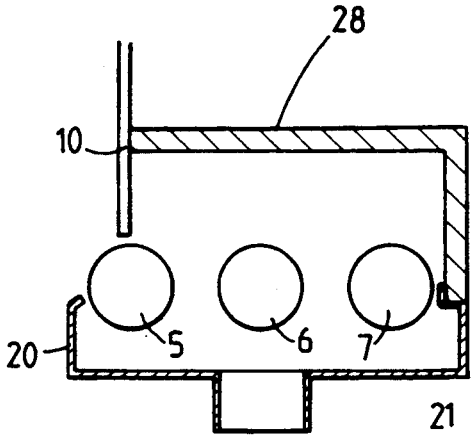
FIG. 6 is a side view showing the arrangement of a lateral gusset.

With respect to the adaptation in width, it is provided, as illustrated in FIGS. 5 and 6, that the two lateral plates 12 and 13 are equipped with means 25 for transverse displacement with respect to the outer upright 26 of the distributor. Moreover, two extensible or sliding members 28 are provided, in the form of gussets or plates, which tightly cover, for each of them, the zone extending on the one hand between the lateral plate 12 and the outer upright 26 and, on the other hand, between the stop 10 and the rear upright 21 of the suction chamber 19.

This particular arrangement makes it possible to obtain suction, between the three supply cylinders, only in the space located between the two lateral plates 12 and 13, i.e. solely where the stack 4 is located.

The present invention is not limited to the embodiment which has just been described by way of non-limiting example. In particular, it would be possible to employ more than three supply cylinders. It will be understood that less than three cylinders would not enable precise positioning of the sheet to be distributed, to be obtained, since, in that case, the following sheet would be entrained during its descent on the outlet cylinder, which is not yet stopped.

Figure 7:
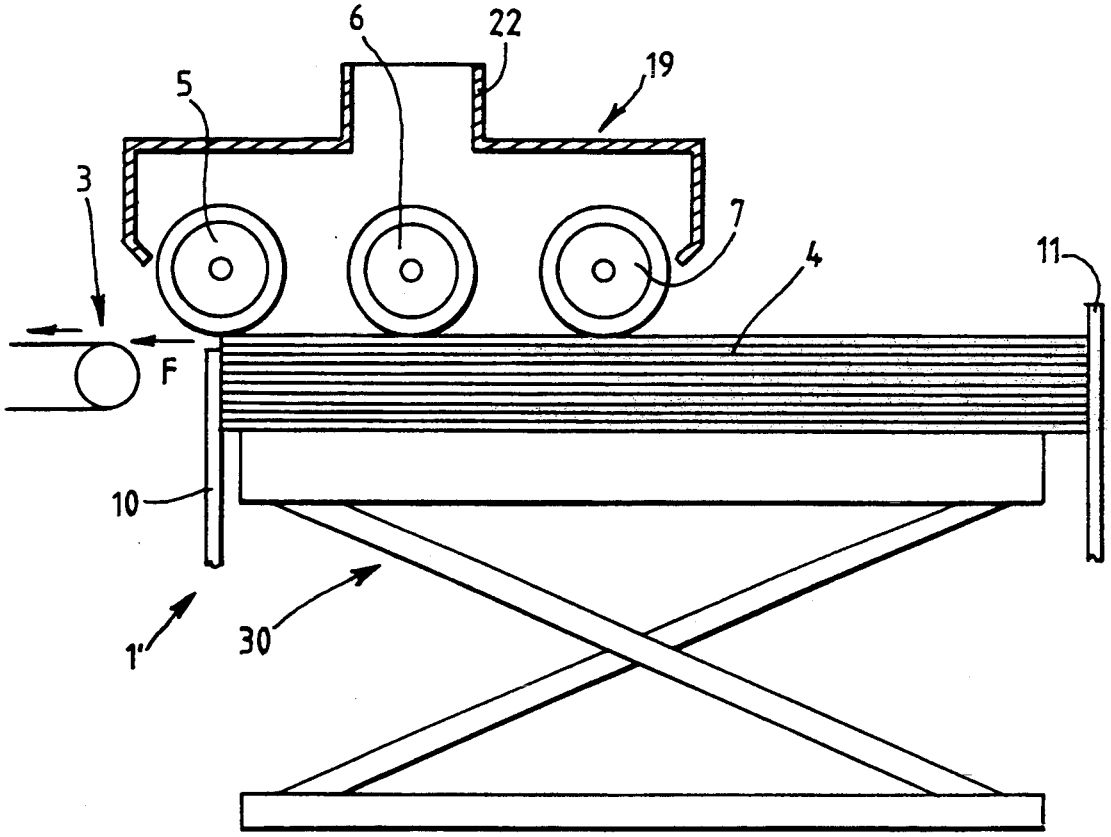
FIG. 7 is a sectional side view of the distributor of this invention which is located above the stack of sheets.

The particular synchronization between the supply cylinders is obtained by any appropriate means 29 as schematically shown in FIGS. 1 and 7, whether they be purely mechanical means as is conventional in the domain of printing cardboard sheet by sheet, or by equipping each of the supply cylinders with an independent motor, particularly an electronic servo-control motor of the brushless type, controlled by an electronic circuit which is connected to the motors driving the supply cylinders and possibly to the system for entraining the sheet in the following station. Where there is only one motor directly driving the outlet cylinder and the other supply cylinders, via for example gears, clutch-brakes would be mounted on said gears. The deceleration and stop sequence would be obtained by successively actuating in braking the clutch-brakes then the motor.

The embodiment which has just been described concerns a distributor with entrainment of the sheets from the bottom of the stack. The invention is also applicable to distributors in which the sheets are removed from the top of the stack as shown in FIG. 7, the latter being maintained against the supply cylinders by an elevator system 30. In that case, the sheet to be distributed passes above the stop behind which the sheets are stacked.

What is claimed is:

1. A device for distributing semi-rigid sheets one by one below a stack of said sheets through a front stop, behind which said sheets are retained said device comprising at least three rotary supply cylinders mounted in a suction chamber which has no fixed surface in contact with the stack in the vicinity of said front stop, said cylinders contacting and entraining an outmost sheet of the stack, an outlet cylinder of said cylinders being located adjacent to the front stop and having an axis in alignment with a vertical retaining surface of the front stop, and means for synchronizing said cylinders so that during distribution of the outmost sheet, each of the cylinder upstream of the outlet cylinder is respectively decelerated after the outmost sheet has left contact therewith and a following sheet has come into contact therewith, said outlet cylinder being decelerated after a rear edge of said outmost sheet has gone through the vertical retaining surface of the front stop and the following sheet has come into contact with the outlet cylinder while the upstream cylinders have stopped.

2. The device of claim 1, wherein the synchronization means are adjusted so as to decelerate the outlet cylinder after the rear edge of the outmost sheet has passed beyond the retaining surface of the front stop by a distance of 10 mm.

3. The device of claim 1 or 2, wherein the synchronization means are adjusted so as to decelerate each cylinder upstream of the outlet cylinder after the rear edge of the outmost sheet has left contact with said cylinder by a distance of 10 mm.

4. The device of claim 1, wherein the synchronization means comprise an independent, electronically servo-controlled motor for each cylinder and an electronic circuit for controlling said motors.

5. The device of claim 1, wherein the synchronization means comprise a motor for driving the outlet cylinder, gears provided with clutch-brakes mounted on shafts of the upstream cylinders and an electronic circuit for controlling the clutch-brakes and the motor.

6. The device of claim 1, wherein the front stop is a continuous plate.

7. The device of claim 1, wherein rotary bearing members, free to rotate, are disposed to support a rear part of the stack, while the supply cylinders support a front part thereof.

8. The device of claim 1 or 7, further comprising means for adaptation to a width of the stack, said adaptation means including two lateral plates for blocking the stack, provided with transverse displacement means, and two extensible or sliding covering members in the form of gussets or plates which tightly cover respectively a zone extending between a lateral plate and an outer upright for the stacked sheets and between the front stop and a rear upright of the suction chamber.

9. A device for distributing semi-rigid sheets one by one above a stack of said sheets through a front stop, behind which said sheets are retained, said device comprising at least three rotary supply cylinders mounted in a suction chamber which has no fixed surface in contact with the stack in the vicinity of said front stop, said cylinders contacting and entraining an outmost sheet of the stack, an outlet cylinder of said cylinders being located adjacent to the front stop and having an axis in alignment with a vertical retaining surface of the front stop, and means for synchronizing said cylinders so that during distribution of the outmost sheet, each of the cylinder upstream of the outlet cylinder is respectively decelerated after the outmost sheet has left contact therewith and a following sheet has come into contact therewith, said outlet cylinder being decelerated after a rear edge of said outmost sheet has gone through the vertical retaining surface of the front stop and the following sheet has come into contact with the outlet cylinder while the upstream cylinders have stopped.

* * * * *